US005421903A

United States Patent [19]

Manabe et al.

[11] Patent Number: 5,421,903

[45] Date of Patent: Jun. 6, 1995

[54] METHOD FOR WASHING A TANK AND FOR RECOVERING AND TREATING RESIDUAL TANK LIQUID

[75] Inventors: Nobuyuki Manabe, Fujisawa; Masaaki Ando, Kobe, both of Japan

[73] Assignee: Taiho Industries Co., Ltd., Tokyo, Japan

[21] Appl. No.: 125,793

[22] Filed: Sep. 24, 1993

[30] Foreign Application Priority Data

Sep. 24, 1992 [JP] Japan ..... 4-277770
May 7, 1993 [JP] Japan ..... 5-028999
Jun. 17, 1993 [JP] Japan ..... 5-169803

[51] Int. Cl.[6] ..... B08B 9/08; B08B 7/04

[52] U.S. Cl. ..... 134/22.1; 134/8; 134/10; 134/21; 134/22.18; 134/40

[58] Field of Search ..... 134/6, 8, 21, 22.12, 134/22.18, 36, 42, 10, 166 R, 168 R, 198, 167 R, 169 R, 109, 22.1, 40

[56] References Cited

U.S. PATENT DOCUMENTS 4,426,233 1/1984 Manabe et al. ..... 134/21
4,770,711 9/1988 Deal, III et al. ..... 134/18
4,945,933 8/1990 Krajicek et al. ..... 134/167 R
5,037,486 8/1991 Sloan ..... 134/18

FOREIGN PATENT DOCUMENTS 4040944 7/1992 Germany .
WO89/09662 10/1989 WIPO .

*Primary Examiner*—Paul Lieberman
*Assistant Examiner*—Lorna M. Douyon
*Attorney, Agent, or Firm*—Oblon, Spivak, McClelland, Maier & Neustadt

[57] ABSTRACT

A system for washing a tank and recovering and treating residual tank liquid comprises a first system unit equipped with a suction device for sucking and discharging residual tank liquid, a second system unit equipped with an oil-water separator for separating oil from the discharged residual liquid, a device for treating the separated oil and a pump for supplying a washing liquid into the tank, a third system unit equipped with an inert gas generator, and first, second and third conveyance vehicle for conveying the first, second and third system units to the tank to be treated. The invention also provides a method of operating the system.

10 Claims, 5 Drawing Sheets

METHOD FOR WASHING A TANK AND FOR RECOVERING AND TREATING RESIDUAL TANK LIQUID

BACKGROUND OF THE INVENTION

1. Field of the Invention

This invention relates to a method for washing a tank and recovering and treating residual tank liquid and, more particularly to such a method for discharging and recovering residual liquid remaining in an oil tank and for, as appropriate, conducting various tank treatments such as discharge and removal of sludge remaining in the tank by breakdown and dissolution with jetted oil, final washing with cold or hot water, and oil-water separation of discharged liquid.

2. Description of the Prior Art

The usual method used for removing the waxy sludge that accumulates in oil tanks is to break down and dissolve the sludge by spraying it with high-pressure liquid from a liquid jetting device and to discharge the dissolved sludge and the jetted liquid out of the tank.

After the interior of the tank has been washed with oil or the like in this manner, the oil film adhering to the inner surface of the tank has to be removed by final washing with cold or hot water so as to make it safe for entry by the maintenance personnel for inspection and repairs.

Various equipment is required for carrying out this washing operation, including a high-pressure oil supply device, a hot water supply device, a suction device for sucking and discharging residual tank liquid, an oil-water separator for separating oil from the discharged residual liquid, a filter treatment device for treating the separated oil and an inert gas supply device for supplying an inert gas into the tank for fire and explosion prevention during tank washing, all of which have to be installed in the vicinity of the oil tank to be treated. The installation of this equipment is very time consuming and costly. The equipment also takes up a considerable amount of space around the tank being treated.

Up to now, therefore, the washing of an oil tank has been an extremely expensive, large-scale operation that has required the tank to be taken out of operation for a long period of time.

The present invention was accomplished in light of the foregoing circumstances and has as one object to provide a system and a method for washing a tank and recovering and treating residual tank liquid.

Another object of the invention is to provide such a system and method that employ a closed system wherein liquid and gas recovered from the tank are returned to the tank for reuse so as to reduce discharge of liquid and gas to the exterior.

SUMMARY OF THE INVENTION

For achieving the aforesaid object, this invention provides a system for washing a tank and recovering and treating residual tank liquid comprising a first system unit equipped with a suction device for sucking and discharging residual tank liquid, a second system unit equipped with an oil-water separator for separating oil from the discharged residual liquid, a device for treating the separated oil and means for supplying a washing liquid into the tank, a third system unit equipped with an inert gas generator, a first conveyance means for conveying the first system unit, a second conveyance means for conveying the second system unit and a third conveyance means for conveying the third system unit.

The invention also provides a method for washing a tank and recovering and treating residual tank liquid comprising the steps of loading the first, second and third system units on separate conveyance means, moving the conveyance means to the site of the tank to be treated, interconnecting the system units with prescribed piping, operating the washing liquid supply means of the second system unit to cause a jetting device thereof to jet washing liquid into the tank, operating the suction device of the first system unit for sucking and discharging residual tank liquid, treating the discharged residual liquid with the oil-water separator of the second system unit, and, in the course of the aforesaid treatments, operating the inert gas supply device of the third system unit for supplying inert gas to the tank interior.

As will be understood from the foregoing, rather than the equipment for washing, residual tank liquid discharge and treatment, and supply of inert gas being installed at the site of the tank as in the conventional manner, in the present invention the equipment is brought to the site loaded on separate conveyance means (vehicles) which can be mobilized on short notice, so that the treatment can be started as soon as the equipment is brought to the site on the conveyance vehicles and interconnected with piping. The treatment can thus be completed in much less time than heretofore. Further, since the size and number of the conveyance vehicles can be selected according to the size and capacity of the tank to be treated, treatment can be conducted economically. In this invention, moreover, the liquid sucked out of the tank is reused as washing liquid or cooling liquid and the inert gas is returned to the interior of the tank. It thus provides a closed system that minimizes discharge to the exterior.

The above and other features of the present invention will become apparent from the following description made with reference to the drawings.

DESCRIPTION OF THE PREFERRED EMBODIMENT

Figure 1:
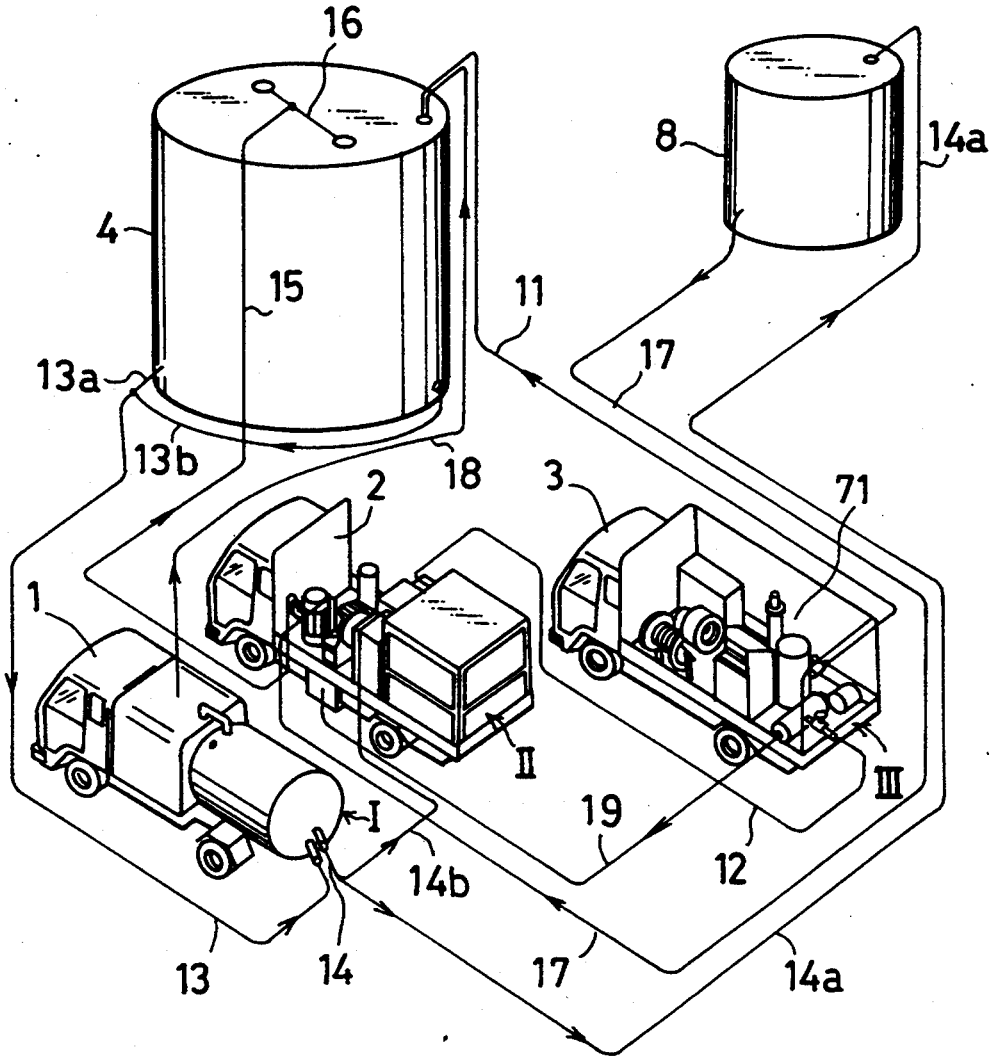
FIG. 1 is an overall schematic view of an embodiment of the invention.

FIG. 1 is an overview of the present invention. A first system unit I equipped with a suction device for sucking and discharging residual liquid from an oil tank 4 into a depressurized tank set up in advance, a second system unit II equipped with an oil-water separator for separating oil from the sucked residual liquid and means for supplying a washing liquid into the oil tank 4, and a third system unit III equipped with an inert gas generator are loaded on three separate conveyance means 1, 2 and 3, such as trucks, and moved to the site of the oil tank 4 to be treated, whereafter the system units I, II and III are interconnected with piping. The interior of the oil tank 4 is then washed and the residual liquid therein is treated.

Figure 2:
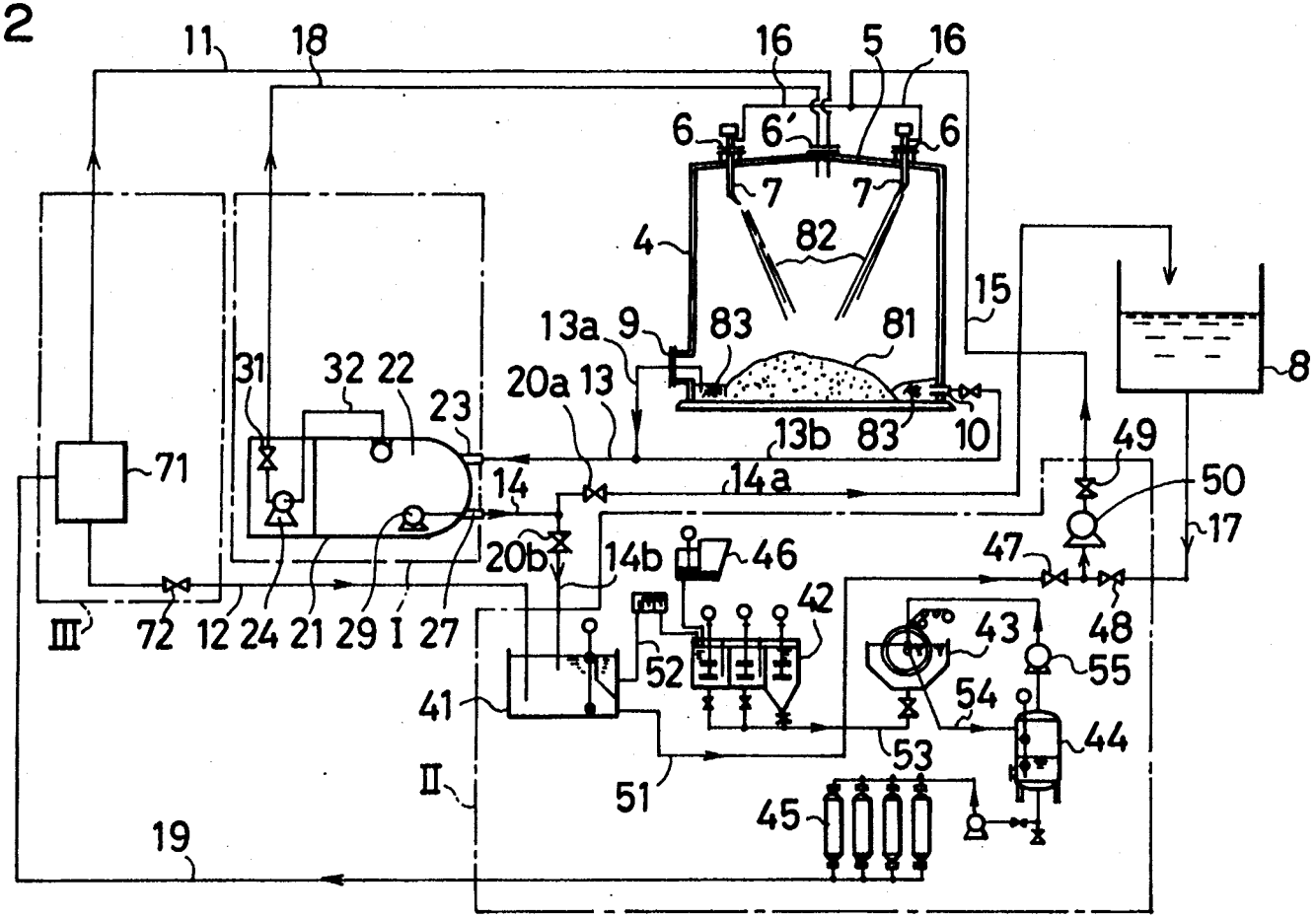
FIG. 2 is diagram for explaining the piping in the embodiment of FIG. 1.

In a case such as shown in FIG. 2 where sludge 81 has accumulated in a fixed-roof oil tank 4, the liquid 83 is drawn from the tank and, at the same time, high-pressure liquid jets 82 from a plurality of jetting devices 7 installed in roof manholes 6 of the fixed roof 5 are directed onto inner wall of the oil tank as well as directly onto the sludge 81 accumulated on the tank floor. As a result, the sludge 81 is fluidized so that it can be sucked and discharged to the exterior together with the jetted liquid, and thus recovered. To prevent a fire or explosion from occurring in the course of the treatment, a prescribed amount of inert gas is fed into the oil tank 4.

Figure 3:
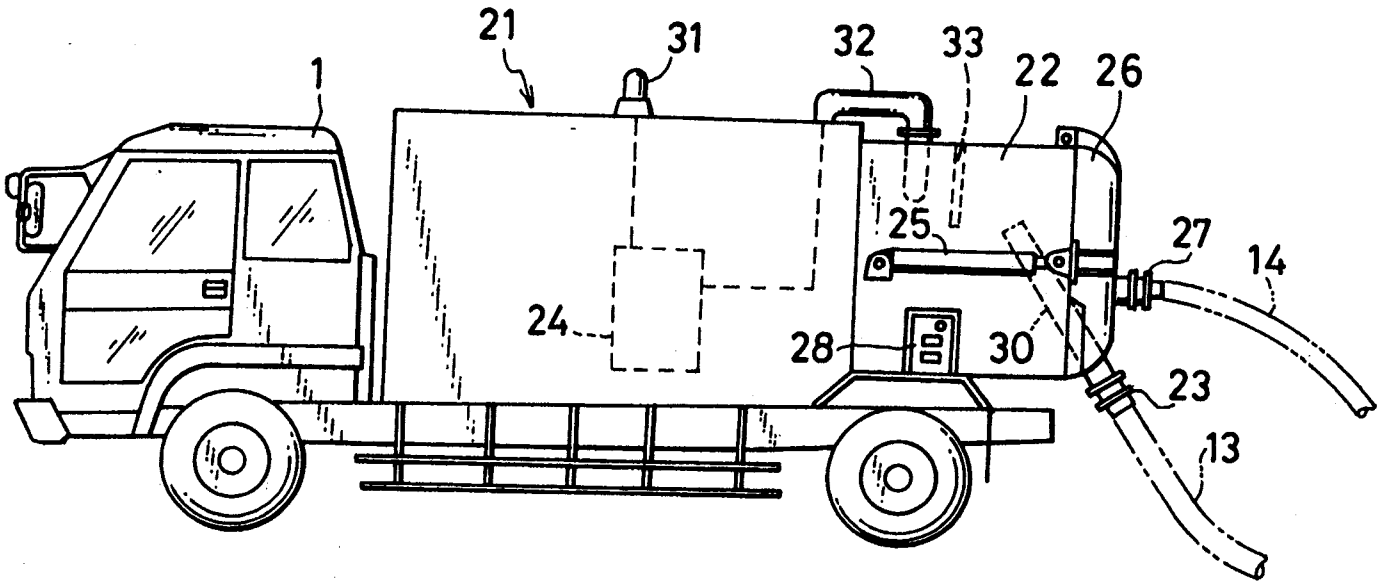
FIG. 3 is side view showing the first system unit of FIG. 1 loaded on the first conveyance vehicle.
Figure 4:
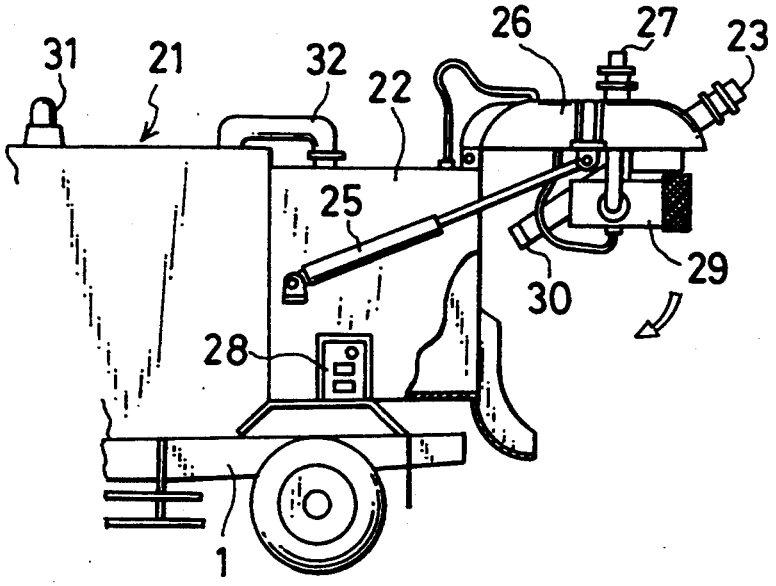
FIG. 4 is an enlarged view of the essential portion of FIG. 3.

FIGS. 3 and 4 show an example of the conveyance means 1 loaded with the first system unit I. The suction device 21 of the first system unit I is equipped with an internal suction blower 24. Operating the suction blower 24 reduces the pressure in a suction tank 22 and the reduced pressure is applied through a suction nozzle to a suction line 13 for sucking the liquid 83 from the oil tank 4.

The suction blower 24, which constitutes a vacuum pump, and the suction tank 22 are connected via a water filter chamber and a flow path provided in a partition wall (neither shown) so as to prevent grit etc. contained in the sucked liquid from getting into the suction blower 24.

At the rear end of the suction device 21, a lid 26 is hinged at its upper edge so as to be openable and closable by the action of telescopic cylinders 25. The suction nozzle 23 and a discharge nozzle 27 are attached to the exterior of the lid 26 and communicate with the interior of the suction tank 22 via valves or the like (not shown).

On the inside of the lid 26, a suction pipe 30 is provided in communication with the suction nozzle 23 and a discharge pump, in the illustrated example a centrifugal pump 29, is attached to have its liquid suction port face the floor of the suction tank 22 and to be in communication with the discharge nozzle 27.

Also shown in the figures are a gas exhaust valve 31, a gas-exhaust pipe 32 connecting the suction tank 22 and the suction blower 24, a shock absorber plate 33 for absorbing the impact of the liquid 83 discharged into the suction tank 22 from the suction pipe 30, and a control panel 28.

Figure 5:
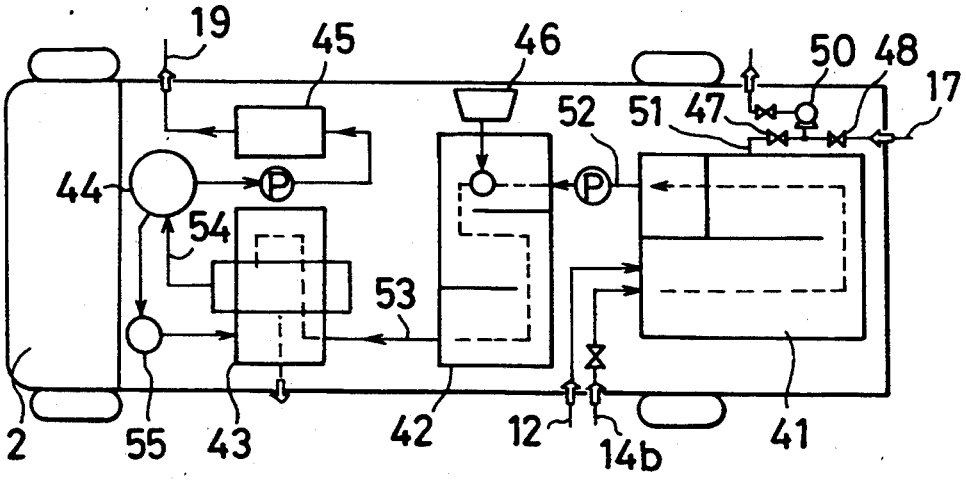
FIG. 5 is a plan view showing the layout of the second system unit of FIG. 1 on the second conveyance vehicle.

As shown in FIG. 5, the second system unit II comprises an oil-water separator 41 for treating liquid received from the first system unit I, an agglutinator 42 for agglutinating the oil-containing emulsion separated by the oil-water separator 41, a filter treatment device 43 for dewatering the agglutinated oil-containing emulsion, and an activated carbon filter tank 45 for removing traces of oil, coagulant and other organic components remaining in the filtrate, all of which are loaded on the conveyance means 2. Also loaded on the conveyance means 2 are a force-feed pump 50 for feeding pressurized washing liquid into the oil tank 4, a first valve 47 connected to the oil-water separator 41 through a hot water discharge pipe 51, a second valve 48 connected with an oil supply line 17 and a third valve 49 connected with an oil and hot water supply line 15. Reference numeral 46 designates a coagulant feeder for supplying coagulant to the agglutinator 42.

Figure 6:
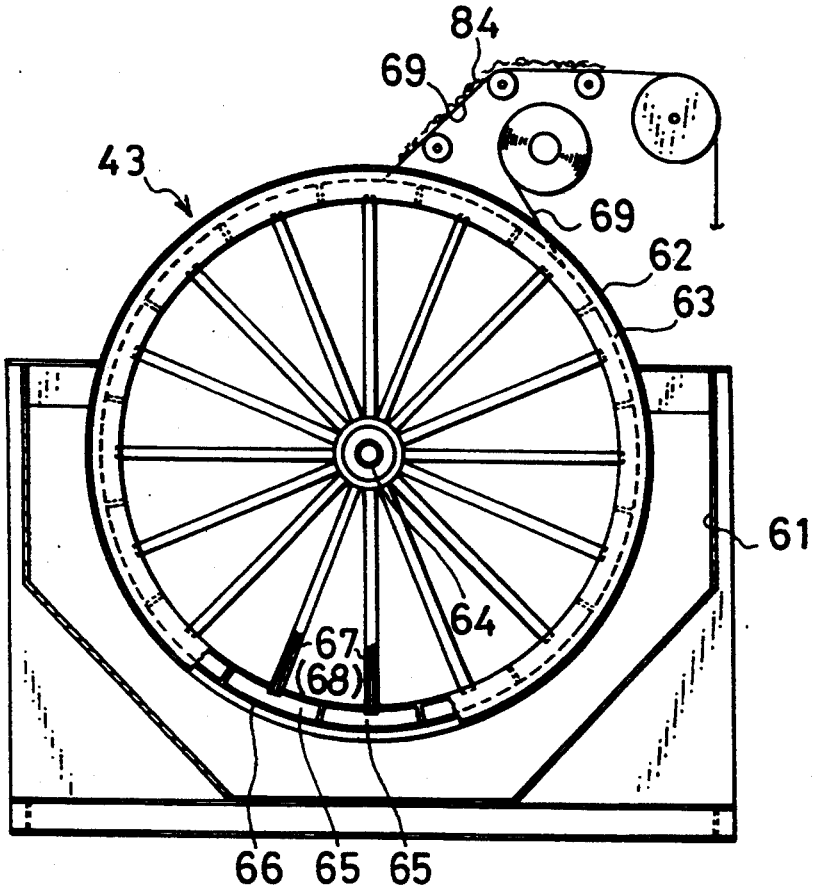
FIG. 6 is a sectional view showing an example of the filter treatment device of the second system unit of FIG. 5.

FIG. 6 shows an example of the filter treatment device 43. A rotating drum 62 is installed in a treatment tank 61 for holding a liquid for treatment including the agglutinated oil-containing emulsion from the agglutinator 42 in such manner that a part of the peripheral portion 63 thereof is exposed above the surface of the liquid for treatment.

The outer surface of the rotating drum 62 consists of a liquid-permeable support material 66 constituted of punched metal, metal mesh or the like and the peripheral portion 63 is constituted of a continuous series of independent cells 65. Each cell 65 is attached to the end a depressurization pipe 67 and a pressurization pipe 68. The other ends of the pipes 67 and 68 are respectively connected with a depressurization hole and a pressurization hole (neither shown) in a rotating shaft 64.

As the rotating drum 62 rotates, the peripheral portion 63 thereof is continuously supplied with a fresh band of filter material 69.

The rotating drum 62 of the filter treatment device 43-is rotated with about half of its peripheral portion 63 immersed in the liquid for treatment. The cells 65 immersed in the liquid for treatment are depressurized and the resulting suction acts on the filter material 69 covering the support material 66 via the cells 65 to suck the oil component 84 of the oil-containing emulsion onto the filter material 69 and draw only the filtrate into the cells 65.

Therefore, since at least the surface portion of the rotating drum 62 immersed in the liquid for treatment is constantly covered with the filter material 69, the oil-containing liquid for treatment does not enter the depressurization mechanism and all of the filtrate sucked in is that which has passed through the filter material 69. As a result, it can be reused or discarded as it is or after having, been passed through the activated carbon filter tank 45.

Once a cell 65 has been moved upward and out of the liquid for treatment by the rotation of the rotating drum 62, it is pressurized. The repulsive force produced by the pressurization detaches the oil-clogged filter material 69 of the support material 66 of the cell 65, whereby the filter material 69 can be readily recovered without breaking or cutting it.

The first, second and third system units I, II and III are configured in the foregoing manner to be immediately operable and are separately loaded on the conveyance vehicles 1, 2 and 3. When an oil tank is to be washed, the conveyance vehicles are brought to the tank site.

Once they have arrived, the suction nozzle 23 provide in the suction device 21 of the first system unit I is first connected with the recovered oil line 13. The conveyance means 2 is split into two branch lines 13*a* and 13*b*. The line 13*a* passes into the oil tank 4 through a side manhole 9 where its suction port is directed toward the floor of the oil tank 4 and the line 13*b* is connected with a drain nozzle member 10 provided in the oil tank 4. A recovered oil line 14 is connected to the discharge nozzle 27. The recovered oil line 14 branches into a line 14*a* which is provided with a valve 20*a* and has its outlet directed into an oil reservoir 8 and a line 14*b* which is provided with a valve 20*b* and has its end connected with the oil-water separator 41 of the second system unit II. Further, the gas exhaust valve 31 is connected with one end of an inert gas recovery line 18 whose other end passes into the oil tank 4 through an air vent 6' in the fixed roof 5 of the oil tank 4.

A third valve 49 of the force-feed pump 50 of the second system unit II is connected with the oil and hot water supply line 15 connected with a connecting pipe 16 that is in turn connected with the jetting devices 7 installed in the roof manholes 6. Further, a second valve 48 connected with the force-feed pump 50 is connected with the oil supply line 17 connected with the oil reservoir 8.

In addition, an inert gas generator 71 of the third system unit III is connected with one end of an inert gas supply line 11 the other end of which passes into the oil tank 4 through the air vent 6' provided in the fixed roof 5 of the oil tank 4. A hot water valve 72 provided on the inert gas generator 71 is connected to a hot water supply line 12 the other end of which disposed in the oil-water separator 41 of the second system unit II.

Once the first system units I, II and III have been moved to the tank site and the prescribe piping connections have been made, washing of the oil tank and the recovery and treatment of the residual liquid is conducted according to the following procedure.

First, for washing the oil tank 4 while jetting oil 82 into the oil tank 4 to break down and dissolve the sludge 81, the suction blower 24 and the centrifugal pump 29 of the first system unit I and the force-feed pump 50 of the second system unit II are operated, the valve **20*a* of the recovered oil line 14*a*, the second valve 48 of the second system unit II and the third valve 49 are opened, and the valve 20*b* of the recovered oil line 14*b*, the first valve 47 of the second system unit II and the valve 72** of the third system unit III are closed.

When the suction blower 24 is operated under these conditions, the pressure in the suction tank 22 becomes negative, giving rise to a suction action at the end of the recovered oil line **13*a*. As a result, liquid 83 accumulated at the bottom of the oil tank 4 is sucked in and passed through the recovered oil line 13 into the suction tank 22. A suction action is similarly produced in the recovered oil line 13*b* connected to the drain nozzle member 10, whereby liquid 83 accumulated at the bottom of the oil tank 4 is sucked in and passed into the suction tank 22. Since a high negative pressure is produced in the suction tank 22 by the combined actions of the suction blower 24 and the centrifugal pump 29, the liquid 83 can be continuously sucked out of the oil tank 4 and passed into the suction tank 22**.

The centrifugal pump 29 discharges the liquid sucked into the suction tank 22 from the discharge nozzle 27, from where it passes through the recovered oil lines 14, **14*a* to the oil reservoir 8. The force-feed pump 50 pumps the liquid (oil) in the oil reservoir 8 through the oil supply line 17, the oil and hot water supply line 15 and the connecting pipe 16 to the jetting devices 7, from which it is jetted into the oil tank 4** under high pressure.

The liquid jetted onto the sludge 81 is sucked back into the suction tank 22 via the recovered oil line 13 and then discharged by the centrifugal pump 29 through discharge nozzle 27 and the recovered oil lines 14, **14*a* into the oil reservoir 8. Thus liquid sucked from the oil tank 4 is circulated for high-pressure jetting of the interior of the oil tank 4. By being jetted under high pressure from the jetting devices 7 it breaks down and dissolves the sludge 81 in the oil tank 4**.

While the sludge 81 is being dissolved, the inert gas generator 71 feeds an inert gas such as nitrogen into the oil tank 4 at a prescribed rate via the inert gas supply line 11. The inert gas sucked out of the oil tank 4 into the suction tank 22 together with the liquid 83 is returned to the oil tank 4 through the gas exhaust valve 31 and the inert gas recovery line 18.

Once the sludge 81 has been thoroughly dissolved and substantially all of the liquid has been discharged from the oil tank 4, the interior of the tank is washed with hot water. During the hot water washing, the suction blower 24, centrifugal pump 29 and force-feed pump 50 are left operating, the valve **20*a* of the line 14*a* and the second valve 48 of the second system unit II are closed, and the first valve 47 of the second system unit II and the hot water valve 72** of the third system unit III are opened.

When the valve 72 is opened, the cooling water in the treatment tank 61 flows through the hot water supply line 12 and accumulates at the bottom of the oil-water separator 41.

The hot water at the bottom of the oil-water separator 41 is drawn out through the hot water discharge pipe 51 and the first valve 47 by the force-feed pump 50 and pumped into the oil and hot water supply line 15 to be jetted into the oil tank 4 under high pressure by the jetting devices 7.

The hot water jetted under high pressure from the jetting devices 7 washes off the oil film adhering to the inner surfaces of the oil tank 4, particularly that adhering to the walls and the ceiling (the undersurface of the fixed roof 5). The used washing water containing the removed oil is sucked via the recovered oil line 13 into the suction tank 22 depressurized by the suction blower 24 and is then delivered to the oil-water separator 41 via the recovered oil line 14 and the line **14*b* by the centrifugal pump 29**.

The oil-water separator 41 separates oil from the oil-containing used washing water and forwards it to the agglutinator 42 via a connecting pipe 52. The agglutinator 42 is supplied with coagulant by the coagulant feeder 46 and agglutinates the oil and contaminants dispersed in the used washing water in the form of floc. The water containing the oil and contaminant components in floc form is passed through a connecting pipe 53 to the filter treatment device 43 where the oil and contaminant components are dewatered and removed. The filtrate separated of the oil and contaminant components is sucked into the filtrate tank 44 depressurized by a vacuum pump 55. The air exhausted from the vacuum pump 55 is sent to the shaft 64 for pressurizing the cells 65 of the filter treatment device 43. The filtrate in the filtrate tank 44 is passed to the activated carbon filter tank 45 where it is completely removed of oil components and, if necessary, returned to the inert gas generator 71 of the third system unit III via a cooling water line 19 for use as cooling water.

Once the oil components have been completely removed from the oil tank 4 by the washing in the foregoing manner, the washing operation is terminated.

If necessary, inert gas is also supplied to the oil tank 4 while it is being washed with hot water.

As explained in the foregoing, the method of the present invention consists of an oil washing step in which sludge accumulated in the oil tank is broken down and dissolved by high-pressure oil jetted from jetting devices and the liquid resulting from the breakdown and dissolution of the sludge and the jetted liquid are sucked into a suction tank by negative pressure in the suction tank, and a hot water washing step which is conducted after the sludge has been dissolved away by the oil washing step. In either washing step, even if the level of the liquid in the oil tank falls below the level of the suction ports so that gas is sucked from the interior of the oil tank, there is no drop in liquid suction efficiency because the negative pressure of the suction tank is maintained by the operation of the suction blower. In addition, since liquid is continuously discharged from the tank while the sludge is being broken down and dissolved by the high-pressure jetting of liquid, the remaining sludge is always exposed above the liquid surface and can therefore be effectively broken down and dissolved.

The used washing oil is recovered and reused as liquid for jetting, the used washing water is recovered and reused as cooling water in the inert gas generator, and the gas recovered from the tank is recovered and returned to the tank. The method can therefore be conducted in a closed system that minimizes discharge to the exterior.

In a case where it is found that inspection, repair or painting of the oil tank interior is hindered by rusting, metal deposition or the like, the invention enables the washing to be completed after the tank interior has been treated with ultra-high pressure wet sanding or jet scraping and then drained. Because of this, the invention is able to dramatically reduce treatment time.

During breakdown and dissolution of accumulated sludge in the oil tank by use of the jetting devices at the time of oil washing, the interior of the oil tank is filled with an inert gas so as to produce an inert atmosphere and protect against any explosion set off by static electricity. However, when the inert gas is sucked out of the tank together with liquid, there is a possibility of atmospheric air entering the tank through small gaps. If this should happen, the composition of the gas in the tank would be altered by the rise in oxygen concentration, making it impossible to maintain an inert atmosphere of desired concentration. In the illustrated embodiment, however, since the vacuum pump discharge pipe opens into the oil tank, the air sucked in through the suction ports is immediately returned to the oil tank, so that there is no change in the gas composition or increase in the oxygen concentration inside the oil tank. Moreover, since all of the gas sucked from the oil tank is returned to the tank, no change occurs in the gas atmosphere in the tank and no inert gas or gas generated from the oil is released into the surrounding atmosphere. The vicinity of the tank is therefore safe from foul odors and explosion.

In the illustrated embodiment, the suction tank has a very large and strong suction capability on the order of nearly 50 $m^3$/min. Since the amount of discharge from the oil tank drain nozzle is small in comparison with this suction capacity, it is always possible to suck out all of the liquid material. Further, the discharge pump used for discharge from the suction tank operates constantly. Therefore, when the discharge pressure drops too low, complete discharge of all sucked in material can be ensured by adjusting the valve in the recovered oil line or the second valve so as to throttle the discharge amount. Since all of the material sucked in can therefore be discharged at all times, the discharge pump is ensured of trouble-free operation.

Most of the solid matter contained in the sucked in liquid settles to the bottom of the suction tank, but since the suction tank is provided with an openable lid, any solid matter, iron rust, sand, stones or mud that accumulates therein can easily be removed. On the other hand, since the suction blower returns all inert gas drawn into the suction tank from the oil tank to the oil tank through the inert gas recovery line, no inert gas passes to the outside and the desired oil tank atmosphere can be easily maintained and adjusted.

The inert gas generator is able to control the atmosphere in the oil tank for optimum safety at all times. Specifically, by producing an inert tank atmosphere containing less than 8% oxygen it eliminates the danger of fire under all operating conditions.

Further, by combining the action of an agglutinator/-stirrer and a vacuum dewaterer, it is possible by the time the washing is finished to lower the oil content of the water extracted from the oil-containing emulsion to 5 ppm or less and no more washing water is required. After washing has been completed in accordance with the invention, precision washing, inspection and the like can be safely conducted.

The present invention has thus been shown and described with reference to a specific embodiment. However, it should be noted that the present invention is in no way limited to the details of the described arrangements but changes and modifications may be made without departing from the scope of the appended claims.

For example, although the foregoing embodiment relates to a case in which the treatment for discharging and recovering residual liquid and the treatment for washing the interior of the tank are conducted as a continuous operation, depending on the amount and state of the residual liquid in the tank as well as on the degree of necessity, it is possible to conduct only the treatment for discharging and recovering residual liquid or only the treatment for washing the interior of the tank, and either case may or may not involve the need to conduct oil-water separation of the discharged liquid and to establish an inert gas atmosphere in the tank.

The various operation modes can be summarized as follows:

In the case of discharge only
- Using only the first system unit
- Using only the second system unit (existing pump used for discharge)
- Using both the first system unit and the second system unit In the case of washing only
- Using the jetting devices and the first system unit
- Using the jetting devices, the first system unit and the third system unit
- Using the jetting devices and the second system unit (existing pump used for discharge)
- Using the jetting devices, the second system unit and the third system unit (existing pump used for discharge).
- Using the jetting devices, the first system unit and the second system unit,
- Using the jetting devices, the first system unit, the second system unit and the third system unit.

As explained in the foregoing, in the method of treating residual tank liquid in accordance with this invention, first, second and third units that have been preassembled and loaded on separate conveyance means are moved to the treatment site, appropriately interconnected with piping and used for various appropriate treatments selected from among, inter alia: discharge and recovery of residual liquid in a tank such as an oil tank; removal of sludge from the oil tank by breaking it down and dissolving it with jetted oil; final washing of the tank with cold or hot water after it has been thoroughly washed with oil; establishment of an inert gas atmosphere in the oil tank during any of the foregoing treatments in order to ensure safety; and oil-water separation of the discharged liquid.

Once the oil tank has been washed with hot water following oil washing, it can safely be precision washed, inspected for leaks etc., and repaired. In contrast to the conventional method of washing relatively small oil tanks, which is labor intensive and thus fraught with dangers that make complete safety management impossible, the method of the present invention enables oil tank washing to be conducted safely, rapidly and reliably, while also enabling ensuing tank management to be conducted safely.

Moreover, since the system units are mounted on conveyance means and interconnected with piping after being brought to the treatment site, the work required in the conventional method for separately transporting various machines and devices to the site and then assembling and installing them is eliminated, thus making it possible to speed up the overall operation. Since there is also no need to secure space for conducting such assembly and installation work, the method of the invention is highly practical for use at the densely built-up facilities that have become more commonplace in recent years.

What is claimed is:

1. A method for washing an oil tank and recovering and treating residual tank liquid, comprising the steps of:

loading on first conveyance means a first system unit equipped with a suction device for sucking and discharging residual liquid from a tank;

loading on second conveyance means a second system unit equipped with an oil-water separator for separating an oil component from residual liquid received from the first system unit, a device for treating the separated oil component and means for supplying washing liquid into the tank;

loading on a third conveyance means a third system unit equipped with an inert gas generator;

moving the first, second and third conveyance means to the tank to be washed;

interconnecting the first, second and third system units with the tank with piping;

operating the means for supplying washing liquid into the tank for jetting washing liquid into the tank;

operating the suction device for sucking and discharging the residual liquid from the tank;

operating the oil-water separator for separating an oil component from the discharged residual liquid;

operating the oil component treatment device for treating the separated oil component;

washing the tank with hot water; and supplying inert gas into the tank during the aforesaid treatments.

2. A method according to claim 1, which comprises washing the tank with oil by jetting into the tank residual liquid sucked from the tank.

3. A method according to claim 1, which comprises cooling the inert gas generator with cold water, heating the cold water and washing the oil tank with the heated water.

4. A method according to claim 1, which comprises cooling the inert gas generator.

5. A method according to claim 1, which comprises returning to the tank inert gas sucked from the tank together with residual liquid.

6. A method for washing an oil tank and recovering and treating residual tank liquid comprising the steps of:

loading on a first vehicle a first system unit equipped with a suction device sucking and discharging residual liquid from a tank;

loading on a second conveyance vehicle a second system unit equipped with an oil-water separator separating an oil component from residual liquid received from the first system unit, a device for treating the separated oil component and a pump supplying washing liquid into the tank;

loading on a third conveyance vehicle a third system unit equipped with an inert gas generator;

moving the first, second and third conveyance vehicle to the tank to be washed;

interconnecting the first, second and third system units with a tank with piping;

operating the pump supplying washing liquid into the tank so as to jet washing liquid into the tank;

operating the suction device sucking and discharging the residual liquid from the tank;

operating the oil-water separator separating an oil component from the discharged residual liquid;

operating the oil component treatment device treating the separated oil component;

washing the tank with hot water; and supplying inert gas into the tank during the aforesaid treatments.

7. A method according to claim 6, which comprises washing the tank with oil by jetting into the tank residual liquid sucked from the tank.

8. A method according to claim 6, which comprises cooling the inert gas generator with cold water, heating the cold water and washing the oil tank with the heated water.

9. A method according to claim 6, which comprises cooling the inert gas generator.

10. A method according to claim 7, which comprises returning to the tank inert gas sucked from the tank together with residual liquid.

* * * * *